US009101197B2

(12) United States Patent
Folise

(10) Patent No.: US 9,101,197 B2
(45) Date of Patent: Aug. 11, 2015

(54) CONVERTIBLE CAMERA KIT BAG

(71) Applicant: Michael J. Folise, Seattle, WA (US)

(72) Inventor: Michael J. Folise, Seattle, WA (US)

(73) Assignee: Tedolph Consolidated Industries, Seattle, WA (US)

( * ) Notice: Subject to any disclaimer, the term of this patent is extended or adjusted under 35 U.S.C. 154(b) by 91 days.

(21) Appl. No.: 13/694,661

(22) Filed: Dec. 20, 2012

(65) Prior Publication Data

US 2014/0175140 A1 Jun. 26, 2014

(51) Int. Cl.

| | |
|---|---|
| ***A45F 4/00*** | (2006.01) |
| ***A45C 13/30*** | (2006.01) |
| ***A45C 15/00*** | (2006.01) |
| ***A45F 3/04*** | (2006.01) |
| ***A45F 5/00*** | (2006.01) |
| ***A45C 1/04*** | (2006.01) |
| ***F41C 33/02*** | (2006.01) |
| ***F42B 39/02*** | (2006.01) |
| ***A45C 7/00*** | (2006.01) |
| ***A45F 3/02*** | (2006.01) |
| ***A45F 4/02*** | (2006.01) |
| ***A45C 11/38*** | (2006.01) |
| ***A45F 3/00*** | (2006.01) |
| *A45C 13/02* | (2006.01) |

(52) U.S. Cl.

CPC . *A45F 3/02* (2013.01); *A45C 11/38* (2013.01); *A45F 3/005* (2013.01); *A45F 4/02* (2013.01); *A45C 13/02* (2013.01); *A45F 2004/023* (2013.01)

(58) Field of Classification Search

CPC ..... A45C 13/02; A45C 3/00

USPC ..... 224/583, 582, 584, 586, 157, 575, 580, 224/653, 654, 655, 223, 660, 681, 682, 224/684; 190/14, 104

See application file for complete search history.

(56) References Cited

U.S. PATENT DOCUMENTS

| | | | | | |
|---|---|---|---|---|---|
| 2,324,194 | A | | 5/1942 | Campiglia | |
| D251,154 | S | | 2/1979 | Wozniak | |
| D252,539 | S | | 8/1979 | Cohee | |
| D258,702 | S | | 3/1981 | Weinreb | |
| 4,330,073 | A | * | 5/1982 | Clark | 224/223 |
| D273,535 | S | | 4/1984 | Weinreb | |
| D276,953 | S | | 1/1985 | Weinreb | |
| D293,506 | S | | 1/1988 | Kappel et al. | |
| D321,981 | S | | 12/1991 | Hanke | |
| D328,550 | S | * | 8/1992 | Mogil et al. | D7/605 |
| 5,172,838 | A | * | 12/1992 | Rowell et al. | 224/680 |
| 5,294,030 | A | * | 3/1994 | Jollivette | 224/681 |
| 5,395,023 | A | * | 3/1995 | Naymark et al. | 224/682 |
| D369,676 | S | | 5/1996 | Palmer | |

(Continued)

OTHER PUBLICATIONS

Jim Domke, Happague, New York, USA (published more than one year prior to the application filing date).

(Continued)

*Primary Examiner* — Brian D Nash

*Assistant Examiner* — Derek Battisti

(74) *Attorney, Agent, or Firm* — Lowe Graham Jones PLLC

(57) ABSTRACT

A convertible camera kit bag has a plurality of receptacles or cells, connected by hinges. A front panel or flap has a tension strip thereon such that, when the front panel is closed and secured, the cells are aligned in a straight row and form a substantially rigid structure. However, when the front panel is open, the cells are free to pivot about the hinge and conform to the shape of a wearer's body.

20 Claims, 5 Drawing Sheets

(56) References Cited

U.S. PATENT DOCUMENTS

| | | | | |
|---|---|---|---|---|
| 5,573,114 | A | 11/1996 | Cyr | |
| D387,249 | S * | 12/1997 | Mogil | D7/607 |
| 5,769,221 | A | 6/1998 | Cyr | |
| 5,775,496 | A | 7/1998 | Cyr | |
| 6,068,402 | A * | 5/2000 | Freese et al. | 383/110 |
| 6,109,496 | A * | 8/2000 | Andrew et al. | 224/664 |
| 6,206,224 | B1 * | 3/2001 | Potts et al. | 220/495.06 |
| 6,244,486 | B1 * | 6/2001 | Holland et al. | 224/584 |
| 6,279,580 | B1 * | 8/2001 | Perez et al. | 128/897 |
| 6,637,633 | B1 * | 10/2003 | Eberle | 224/582 |
| 6,789,711 | B2 * | 9/2004 | Kinsella | 224/275 |
| D499,251 | S | 12/2004 | Chen et al. | |
| 6,899,257 | B2 * | 5/2005 | Jones | 224/680 |
| D614,867 | S | 5/2010 | Johnson | |
| D633,296 | S * | 3/2011 | Potts et al. | D3/305 |
| 7,958,920 | B1 * | 6/2011 | Olsson | 150/112 |
| 2002/0014507 | A1 | 2/2002 | Snider et al. | |
| 2008/0185413 | A1 * | 8/2008 | Marques et al. | 224/674 |
| 2011/0114688 | A1 * | 5/2011 | Peng et al. | 224/600 |
| 2011/0186611 | A1 * | 8/2011 | Eberle | 224/583 |
| 2012/0267365 | A1 | 10/2012 | Sabounjian | |

OTHER PUBLICATIONS

TAMRAC, Inc., 3442—Rally 2 Camera Bag, 2010, Chatsworth, California, USA (published more than one year prior to the application filing date).

* cited by examiner

CONVERTIBLE CAMERA KIT BAG

CROSS REFERENCE TO RELATED APPLICATIONS.

This non-provisional utility patent application claims the benefit of the filing date of copending U.S. provisional patent application Ser. No. 61/580,015 filed Dec. 23, 2011 under 35 U.S.C. §119(e) and priority under 35 U.S.C. §120.

TECHNICAL FIELD

The invention relates to camera bags. More specifically, the invention relates to camera bags that are convertible from a shoulder bag to a belt bag.

BACKGROUND OF THE INVENTION

A wide variety of camera bags are available. Cameras with interchangeable lenses need camera bags that have multiple receptacles for camera bodies and accessory lenses. Larger cameras such as digital single lens reflex (DSLR) cameras require camera bags with very large receptacles. A new format of compact interchangeable-lens camera has recently become available with smaller image sensors under the designation "micro 4/3". The smaller sensor and shorter lens flange-to-sensor distance permits these cameras to have much smaller bodies, as the cameras do not have mirror boxes as do conventional DSLR cameras. That is, these cameras do not have the moving reflex mirror and mirror box of conventional DSLRs and have a much shorter sensor to lens flange distance, approximately 19.6 mm, compared to approximately 50 mm sensor to lens flange distance for a conventional DSLR camera. An electronic display, such as a liquid crystal display (LCD) or an electronic viewfinder (EVF), or both, provides a live view directly from the camera sensor through the camera lens. By eliminating the SLR mirror box, short focal-length lenses do not have to be provided with retro-focus designs and, again can be and are much smaller than their DSLR counterparts. The micro 4/3 format is just one form of a new breed of camera generally referred to as mirrorless interchangeable lens cameras (MILC) or compact interchangeable lens cameras (CILC), and even electronic viewfinder interchangeable lens (EVIL) cameras. As a result of the above, camera kit bags designed for DSLR cameras are much too large for micro 4/3 camera and lenses. Additionally, large camera bags are generally rigid and cannot conform to the shape of the human body and are thus unwieldy. Bags of this type often disadvantageously have zippered tops that impede access to the receptacles when the bag is being worn by the photographer as a shoulder bag. Camera backpacks, while excellent for carrying a large amount of equipment comfortably, generally do not provide access to the equipment while being worn.

One prior-art approach to resolving these issues is the so-called photographer's vest. This vest has a plurality of pockets to receive various photographic accessories and is worn by the photographer over his or her clothes. The photographer's vest is very functional and in some ways ideal for a small camera system but such vests can be cumbersome, hot to wear and sartorially inappropriate for formal events such as weddings.

Another prior-art approach to resolving these issues is the so-called photographer's belt. This device is similar to a military utility belt with various cylindrical zipper-topped pouches disposed around the perimeter of the belt. This device is popular with sports photographers. However, the belt interferes with the free movement of the photographer's hands and arms, and makes sitting at a banquet table, such as at a wedding, difficult. The photographer's belt is also poorly configured for storing and transporting the camera and camera accessories. Most photographers who use a photographer's belt use a different type of bag or backpack to store and transport the camera equipment to the location of the shoot, and then transfer the equipment into the belt for use.

Belt bags for compact fixed-lens cameras also exist in the prior art but are generally too small for a micro 4/3 camera and a selection of two or three lenses.

Thus, a need exist for a micro 4/3 camera kit bag that conforms to the shape of a photographer's body, can accommodate a micro 4/3 camera and a small selection of lenses, and can be carried by the photographer in a variety of ways for facilitating access to the camera and accessories and for safely transporting the same.

BRIEF SUMMARY OF THE INVENTION

It is therefore an object of the present invention to provide a camera kit bag for a compact system camera that can conform to the body of a user.

It is a further object of the present invention to provide a camera kit bag that achieves the above object and which also converts between a shoulder-mounted bag and a waist-mounted bag.

It is yet another object of the present invention to provide a camera kit bag that achieves the above objects and which also presents the camera accessories in the bag to the photographer in a manner that facilitates removing and replacing items stored in bag receptacles.

The invention achieves the above objects, and other objects and advantages, which will become apparent from the description that follows, by providing a convertible kit bag for a compact camera system having a plurality of elongated, hingedly interconnected cells defining open-ended receptacles for a compact camera and/or compact camera accessories, such as interchangeable lenses or an external flash. The bag is preferably provided with a two-position top portion having a top flap for covering the open ends of the receptacles and a front flap connected thereto for covering at least a portion of the front of the bag when the top portion is in a first closed position, and for revealing the receptacles when the top portion is in a second, open position. The bag is also preferably provided with left and right side tension connectors located on a leftmost and on a rightmost side panel of outermost cells. The bag further includes a carry strap connected to the bag. In one preferred embodiment, the carry strap has a first end connected to the leftmost side panel and a distal second end connected to the rightmost side panel. Finally, the bag has an elongated tension strip, connected to the front flap having buckles or the like for cooperatively engaging the tension connectors and also having a length selected such that, with the top flap in the closed position and the tension strip engaged with the tension connectors, the cells are laterally compressed and form a substantially ridged, unitary structure, and wherein when the top portion is in the open position the cells can pivot so that when the bag is hanging by the carry strap on a user the cells can define an arcuate arrangement closely conforming to the user's body.

In a preferred method of use of the preferred embodiment, the carry strap can be removed from the kit bag such that the carry strap now has two free ends. The tension strip can be reengaged with the connectors while the top portion is in the open position, such that the top portion and a rear wall of the cells form an elongated belt loop. One free end of the carry strap can then be threaded through the belt loop. The carry strap can then be positioned around the waist of a user and the free ends thereof reengaged with one another so that the kit bag achieves the configuration of a form-fitting, open-topped belt bag. In the preferred method of use, prior to reengaging the tension strip with the connectors the strip is rotated through 180 degrees about a longitudinal axis defined by the strip so that the strip has a rotational orientation identical to its initial rotational orientation.

In the preferred embodiments of the invention, each cell is provided with opposed elongated side panels spaced apart by opposing front and rear panels and a bottom panel at one end of each cell to define the receptacle. In addition, the receptacle itself can be rigid or semirigid. Alternatively, the receptacles can be nonrigid and provided with rigid, soft-sided, open-topped, removable inserts.

DETAILED DESCRIPTION OF THE PREFERRED EMBODIMENTS

Figure 1:
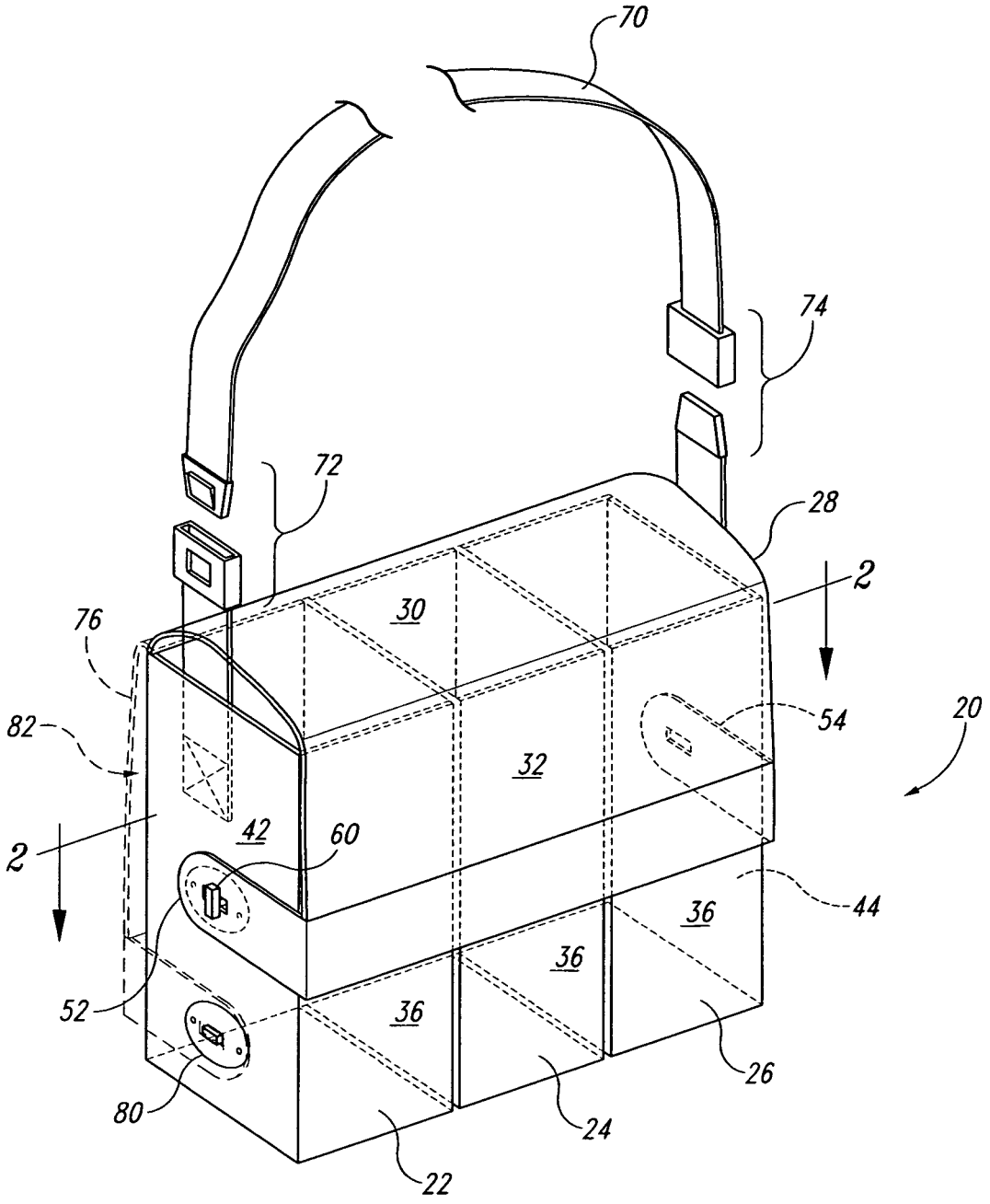
FIG. 1 is a perspective view of a convertible camera kit bag in accordance with the general principles of the invention.

A convertible camera kit bag in accordance with the principles of the invention is generally indicated at reference numeral 20 in the various Figures of the attached drawings, wherein numbered elements in the Figures correspond to like-numbered elements herein.

Figure 3:
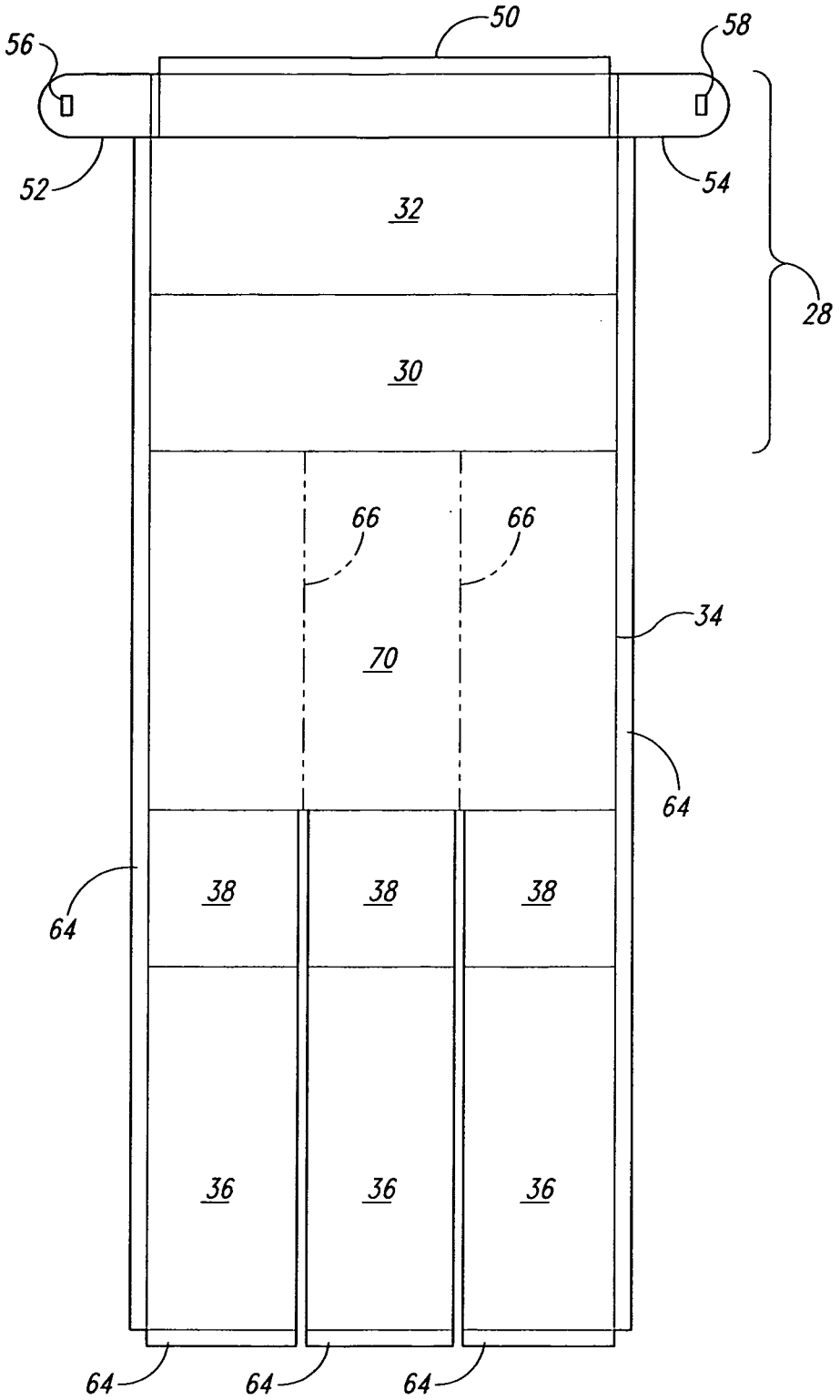
FIG. 3 is a plan view of a continuous piece of material forming the main body of the bag.
Figure 4:
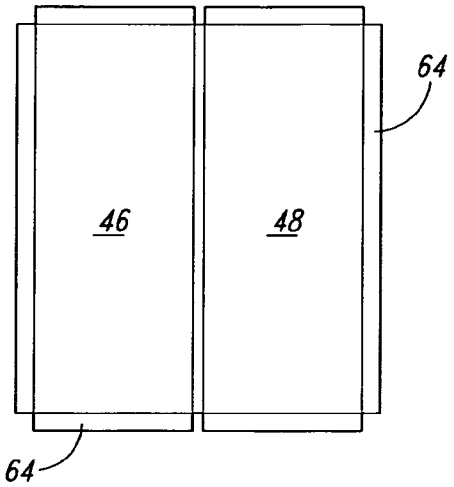
FIG. 4 is a plan view of one of two interior side panels for the bag.

The camera kit bag 20 consists of a plurality of open-topped cells consisting of leftmost cell 22, center cell 24, and rightmost cell 26. As will be described in greater detail hereinbelow, the cells have open tops that are closed by a top portion 28 consisting of a top flap 30 and a front flap 32. As best seen in FIG. 3, the bag has a main body 34 preferably manufactured from a flexible material such as number 10 cotton duck, having a waxed surface for weather resistance. Each cell consists of a front panel 36, a bottom panel 38, and rear panels formed from a single continuous rear wall 40. With respect to the leftmost and rightmost cells 22, 26 outer sides of those cells are closed by leftmost and rightmost side panels 42, 44, which are also preferably made from a flexible material such as No. 10 waxed cotton duck. Interior sidewalls of the cells are closed by interior left and right side panels 46, 48, which are preferably manufactured from a single piece of material, as shown in FIG. 4, also of the same material as the main body and leftmost and rightmost side panels.

Figure 7:
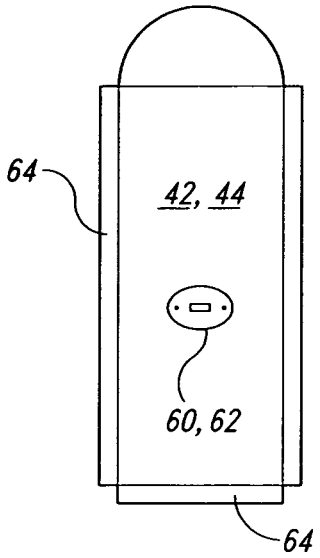
FIG. 7 is a side elevational view of a leftmost side exterior panel of the bag, the right most side panel being a mirror image thereof.
Figure 8:
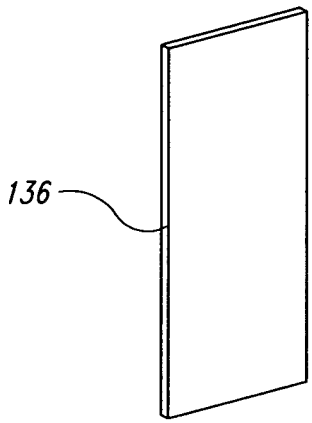
FIG. 8 is a perspective view of a plastic stiffener for use with the cell insert shown in FIG. 5.

The front flap 32 is provided at a distal end thereof with an elongated tension strip or strap 50, having a length wider than the width of all of the combined cells and terminating in left and right free ends 52, 54, defining apertures 56, 58, for receipt of left and right turnbuckles 60, 62, best seen in FIG. 7. The side panels 42, 44, 46, and 48 are each preferably provided with flanges 64 as is the main body 34 of the bag 10 so that the side panels, rear wall 40, bottom panels 38 and front panels 36 can all be connected, such as by gluing, sewing, ultrasonic welding, or any other means within the skill level of an artisan in the relevant art. When they are connected in this way, each adjacent cell is interconnected along the rear wall 40 by living hinges indicated at phantom lines 66 in FIG. 3. These hinges permit the cells to pivot with respect to one another when the tension strap 50 is not secured to the leftmost and rightmost sidewalls 42, 44 and adapt to the shape of a user's body, as best seen in FIG. 2.

The bag 20 is preferably provided with a carry strap 70, best seen in FIG. 1, which is attached to the leftmost and rightmost sidewalls 42, 44 by way of a releasable female/male connector 72 and at a distal end with a releasable male/female connector 74. Of course, the sequential ordering of the connectors may be reversed and the connectors may be unisex. As used herein, male/female and the contrary are intended to encompass unisex connectors too. The strap is preferably adjustable through a conventional adjustment mechanism (not shown) such that the carry strap 70 can be conveniently adjusted on a user's shoulder, such that the bag rests around a photographer's hip as shown in FIG. 2. The bag 20 is provided with a means for converting into an open-topped belt bag by moving the top portion 28 from the solid-line position shown in FIG. 1 to the dotted-line open position 76 shown in FIG. 2. The tension strap 50 may be connected to an alternate set of turnbuckles 80, as shown in FIG. 1, so as to form an elongated belt loop 82 for passage therethrough of the carry strap 70 in the fashion of a belt. The secondary or alternate turnbuckles 80 are preferably not provided and a method of use is disclosed wherein the tension strip 50, when disconnected from the turnbuckles 60, 62, defines an elongated, longitudinal axis. When the top portion 28 is moved to the open position 76, the tension strap 50 is rotated about that longitudinal axis 180 degrees so that it assumes the same orientation, as shown in solid lines in FIG. 1 except that it is now on the rear of the bag. If the length of the front flap 32 and width of the tension strap 50 are selected appropriately, the elongated belt loop 82 will not contain excessive fabric or material and the bag in its open position, as shown in FIG. 2, will fit snugly around the wearer.

Figure 2:
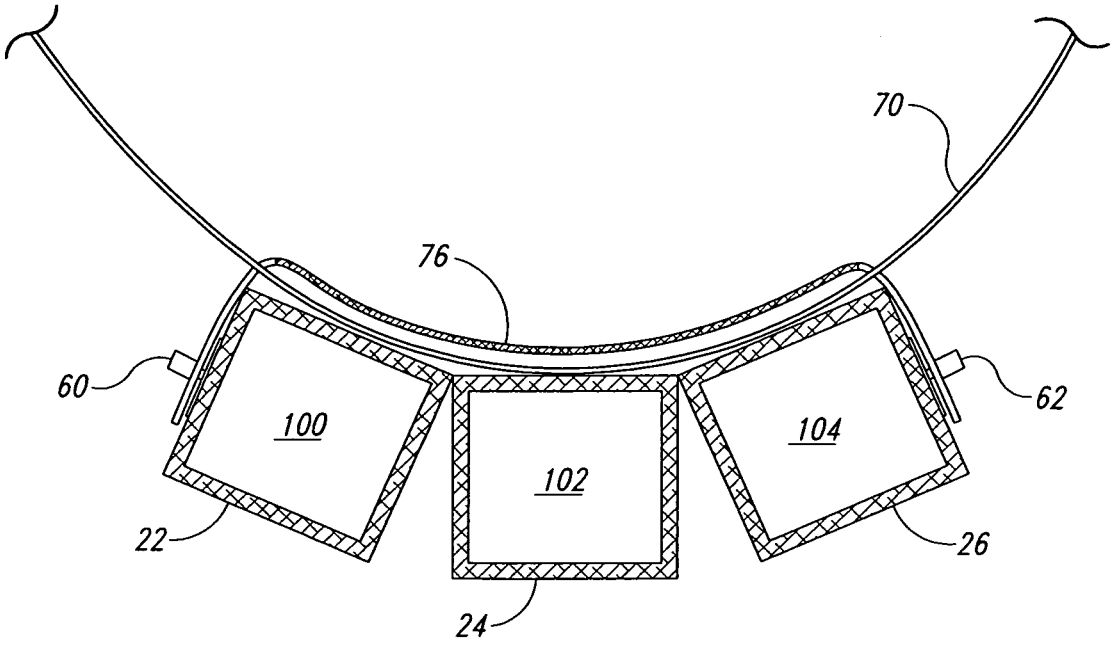
FIG. 2 is partial, cross-sectional view of the bag converted into an open-topped, open-receptacle camera bag in the form of a belt bag having a belt passing through an elongated belt loop.
Figure 5:
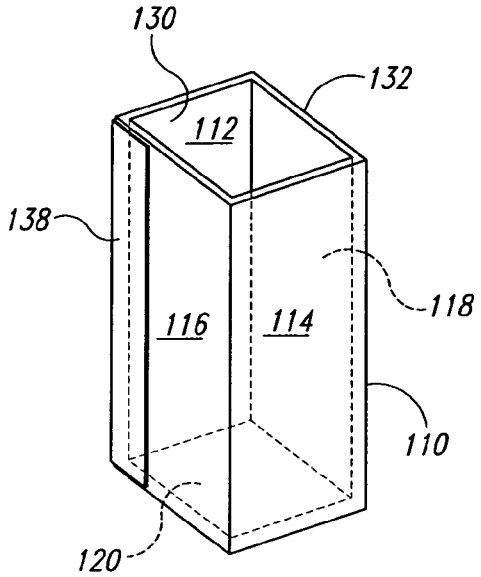
FIG. 5 is a perspective view of a stiffened insert for cells of the bag.

As best seen in FIG. 2, each cell 22, 24, and 26 defines a corresponding open receptacle 100, 102, and 104. Each receptacle is preferably sized to closely receive a camera and/or camera accessories, such as an interchangeable lens. With respect to micro 4/3 cameras, it has been determined that an optimal width for each cell is approximately three inches; an optimal depth for each cell is 2.75 inches; and an optimal height for each cell is approximately 2.25 inches. As has been described, it is preferable to manufacture the main body and sidewalls of the bag from a flexible, weather-resistant material, such as waxed cotton duck fabric. However those of ordinary skill in the art will appreciate that other materials, such as nylon may be substituted. In addition, the cells may be manufactured from a rigid material, such as a vinyl-covered particleboard. In the preferred embodiment, however, the cells are provided with stiffened inserts 110 shown in FIG. 5.

Figure 6:
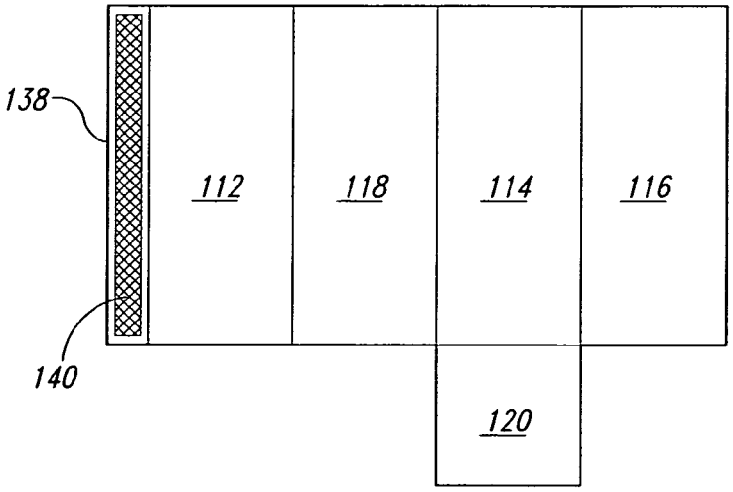
FIG. 6 is a plan view of the stiffener shown in FIG. 5 in an unfolded position.
Figure 9:
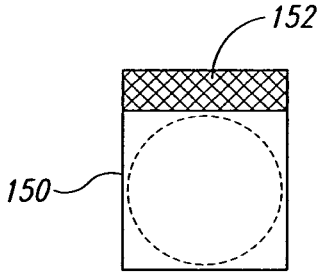
FIG. 9 is a plan view of an interior hinged false floor for creating two vertically aligned receptacles in the insert shown in FIG. 5.
Figure 10:
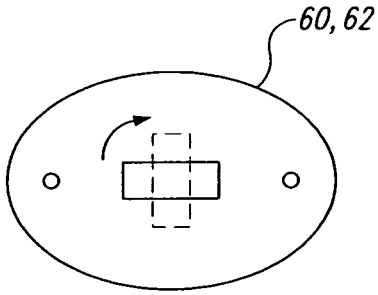
FIG. 10 is a side elevation view of a rotary buckle shown in FIGS. 1 and 7.

Each insert consists of a leftmost 112, rightmost 114, rear 116, and front 118 panel, as shown in FIG. 6. A bottom panel 120 is also preferably provided having one edge 122 connected to a corresponding edge of the rightmost panel 114. The stiffened insert 110 is preferably manufactured from a cushioned fabric having a hook-compatible fabric on the interior side 130 as well as the exterior side 132, such that each panel forms a pocket for receipt of a stiffener 136 having slightly smaller general dimensions. High-density polyethylene sheet has been found to be a suitable material for this purpose. A side edge 138 of the leftmost panel 112 is provided with a strip of hook material 140, such as at that sold under the brand name Velcro®, manufactured by Minnesota Mining and Manufacturing Company, St. Paul, Minn., U.S.A. The hook material 140 will then bind with the outside of the rear panel 116 to form the open-topped insert shown in FIG. 5. Each insert is then placed inside each open-topped cell so that the cell is substantially rigid and protects the contents thereof. A false floor 150, as shown in FIG. 9, may be provided to vertically divide one of the stiffened inserts 110 into upper and lower chambers. The false floor has hook material strip 152 for adhering to an interior side 130 of one of the inserts so as to divide the cell into chambers. The flip-up floor has a width approximately equal to the width of the cell, and a length approximately one inch shorter than the length or depth of the cell, so that a user's finger may easily raise and lower the floor. The flip-up false floor is also preferably provided with a stiffening panel similar to panel 136, except sized appropriately.

The preferred embodiment of the convertible camera kit bag 20 is preferably sized as described above for micro 4/3 cameras and accessories. To that end, the single piece of material shown in FIG. 3 preferably has a total length of 19.25 inches and a total width of 9.5 inches (including flanges), wherein each front panel 36 is 5.25 inches long, each bottom panel 38 is 2.75 inches deep, each rear panel comprising the entire rear wall 40 is 5.25 inches tall, corresponding to the front panel, and the top flap 30 is 2.75 inches wide, corresponding to the depth of the bottom panel 38. The front flap 32 is preferably 3 inches long and has the tension strip or strap 50 sewn thereon. It is preferable to provide the turnbuckles 60, 62 on the leftmost and rightmost panels 42, 44 midway or forward of a vertical bisector of the side panels, and at or lower than a horizontal bisector of the leftmost and rightmost side panels such that the tension strap, when engaged with the turnbuckles, applies a torque on the hinges 66 and places the entire assembly under tension, causing the cells to rotate about their respective hinges 66, so that the cells form a substantially solid unit for transporting the bag and its contents.

At the photography site, the turnbuckles 60, 62 are opened and the top portion 28 positioned along the rear wall 40 of the bag 20 in the open position 76 shown in FIG. 1 while the camera is worn by a camera strap on the photographer's neck or shoulder. The cells will pivot about the hinges 76, closely conforming to the photographer's body, especially if the carry strap 70 is slung over the photographer's opposite shoulder. Advantageously, the top portion 28 can be adjusted by rotating the tension strip 50, as described previously, into its original orientation and reconnecting the same to the turnbuckles, as shown in FIG. 2. The carry strap 70 is then threaded through the elongated belt loop 82 formed by the rear wall of the bag and the top portion 28 with the carry strap reattached to the user as a waist belt. The cells are narrow enough so that the entire assembly can be rotated around the front of the photographer against the photographer's stomach, while still permitting the photographer to wear a sports coat or jacket as may be appropriate for a formal situation, such as a wedding. The open tops 100, 102, and 104 of the receptacles provide the photographer with immediate access to accessories, such as lenses and strobes, while the camera is worn around the photographer's neck. When the photographic task is accomplished, the kit bag is reassembled into its closed configuration, as shown in FIG. 1 for transport. In alternate embodiments of the invention, the top flap 30 may be provided with stiffeners 136 to improve the crush resistance of the bag and external accessory pouches may be added.

Those of ordinary skill in the art will conceive of other alternate embodiments of the invention upon reviewing this disclosure. Thus, the invention is not to be limited to the above description, but is to be determined in scope by the claims, which follow.

I claim:

1. A convertible kit bag for a compact camera system, comprising:

a plurality of elongated interconnected cells arrangeable in a single row, each cell having opposed elongated side panels spaced apart by opposing front and rear panels and a bottom panel at one end of each cell so as to define open-ended receptacles for a compact camera and compact camera accessory, wherein adjacent cells are connected by a vertical hinge between the rear panels;

a top portion having a top flap for covering the open ends of the receptacles and a front flap connected thereto for covering at least a portion of the front panels when the top portion is in a closed position and for revealing the receptacles when the top portion is in an open position;

left side and right side tension connectors located on a leftmost and on a rightmost side panel of outermost cells;

a carry strap having a first end connected to the leftmost side panel and a distal second end connected to the rightmost side panel; and, an elongated tension strip defining a longitudinal axis, connected to the front flap having means for cooperatively engaging with the tension connectors and also having a length selected such that with the top flap in the closed position and the tension strip engaged with the tension connectors the cells are laterally compressed and form a substantially rigid, unitary structure, and wherein when the top portion is in the open position the adjacent cells can pivot on the hinge so that the bag when hanging by the carry strap on a user substantially conforms to the curvature of the user's body.

2. The kit bag of claim 1, wherein the carry strap is selectively detachable therefrom and convertible to a hip belt, and wherein the top portion when in the open position has a front flap length selected such that the tension strip can be reconnected to the tension connectors so as to form an elongated belt loop for the converted carry strap, whereby the kit bag substantially conforms to the shape of a human wearer and presents the open ends of the receptacles to the user in an arcuate fashion to facilitate entry and egress of the camera and camera accessory from the receptacles.

3. The kit bag of claim 2, wherein the leftmost side panel has one end of a male/female releasable strap connector, wherein the first end of the convertible carry strap has the remaining end of the male/female strap connector, wherein the rightmost panel of the cells has one end of a releasable female/male strap connector and the distal end of the carry strap has a remaining end of the female/male strap connector, whereby the ends of the convertible carry strap can be cooperatively engaged as a belt and the releasable strap connectors define a sequence.

4. The kit bag of claim 3, wherein the sequence of the releasable strap connectors are reversed.

5. The kit bag of claim 1, wherein the cells are manufactured from a substantially nonrigid material and each cell is provided with a substantially rigid insert.

6. The kit bag of claim 5, wherein the each insert has side, front, and bottom panels corresponding to the cell panels and wherein the insert panels are substantially rigid.

7. The kit bag of claim 1, wherein the tension strip is an integral structure with the front flap.

8. The kit bag of claim 1, wherein the tension strip is a separate structure from the front flap in the form of a tension strap.

9. The kit bag of claim 1, wherein the side, front, and back panels and the top portion are all part of a continuous piece of material.

10. The kit bag of claim 9, wherein the material is waxed cotton canvas.

11. A method of converting a compact camera kit bag from a substantially rigid shoulder bag to a form fitting, open topped bag, comprising the steps of:

providing a compact camera kit bag having a plurality of pivotally connected, open-topped cells alignable in a single row, each cell being hingedly connected to an adjacent cell along a rear panel thereof, the kit bag further having a top portion with a top flap and a front flap sufficiently elongated to cover at least a part of a front panel of the cells and having an elongated tension strip on the front flap for engaging connectors on leftmost and rightmost side panels of outer ones of the cells, including a convertible carry strap, selectively connectable to the rightmost and leftmost side panels;

disengaging the tension strip from an initial rotational orientation engaged with the connectors with the top portion in the closed position;

opening the top portion and repositioning the same against the rear panels in an open position so that a user can access the receptacles, whereby the adjacent cells pivot about the hinge when the kit bag hangs from a user by the carry strap and substantially conforms to a curved shape of the user's body.

12. The method of claim 11, including the steps of removing the carry strap from the kit bag such that the carry strap now has two free ends, reengaging the tension strip to the connectors with the top portion in the open position such that the top portion and the cell rear panels form an elongated belt loop and threading one free end of the carry strap through the belt loop.

13. The method of claim 12, including the step of positioning the carry strap around a waist of a user and engaging the free ends so that the kit bag achieves the configuration of a form-fitting, open-topped belt bag.

14. The method of claim 12, including the steps of prior to reengaging the tension strip with the connectors, rotating the strip through 180 degrees about a longitudinal axis defined by the strip so that the strip has a rotational orientation identical to its initial rotational orientation.

15. A convertible kit bag for a compact camera system, comprising:

a plurality of elongated, hingedly interconnected cells arranged in a single row, each cell having opposed elongated side panels spaced apart by opposing front and rear panels and a bottom panel at one end of each cell so as to define open-ended receptacles for a compact camera and a compact camera accessory;

a two-position top portion having a top flap for covering the open ends of the receptacles and a front flap connected thereto for covering at least approximately one half of the front panels when the top portion is in a closed position and for revealing the receptacles when the top portion is in an open position;

left and right side tension connectors located on a leftmost and on a rightmost side panel of outermost cells;

a carry strap connected to the bag; and, an elongated tension strip defining a longitudinal axis, connected to the front flap having means for cooperatively engaging with the tension connectors and also having a length selected such that with the top flap in the closed position and the tension strip engaged with the tension connectors the cells are laterally compressed and form a substantially rigid, unitary structure, and wherein when the top portion is in the open position the cells can pivot so that the bag when hanging by the carry strap on a user the cells can define an arcuate arrangement.

16. The kit bag of claim 15, wherein the carry strap has a first end releasably connected to the leftmost side panel and a distal second end releasably connected to the rightmost side panel whereby the strap is selectively detachable from the bag and convertible to a hip belt.

17. The kit bag of claim 16, wherein the top portion when in the open position has a front flap length selected such that the tension strip can be rotated 180 degrees and reconnected to the tension connectors so as to form an elongated belt loop for the converted carry strap, whereby the kit bag substantially conforms to the shape of a human wearer and presents the open ends of the receptacles to the user in an arcuate fashion to facilitate entry and egress of the camera and camera accessory from the receptacles.

18. The kit bag of claim 15, wherein the leftmost side panel has one end of a male/female releasable strap connector, wherein the first end of the convertible carry strap has the remaining end of the male/female strap connector, wherein the rightmost panel of the cells has one end of a releasable female/male strap connector and the distal end of the carry strap has a remaining end of the female/male strap connector, whereby the ends of the convertible carry strap can be cooperatively engaged as a belt and the releasable strap connectors define a sequence.

19. The kit bag of claim 18, wherein the sequence of the releasable strap connectors are reversed.

20. The kit bag of claim 15, wherein the cells are manufactured from a substantially nonrigid material and each cell is provided with a substantially rigid insert.

* * * * *